United States Patent [19]

Bügener et al.

[11] 4,416,094

[45] Nov. 22, 1983

[54] ATTIC WINDOW ASSEMBLY

[75] Inventors: Franz Bügener, Heusenstamm; Manfred Rinklake, Friedrichsdorf; Werner Horch, Dietzenbach; Wilhelm Röttger, Heusenstamm; Günter Jöst; Johann Kirsch, both of Rodgau, all of Fed. Rep. of Germany

[73] Assignee: Braas & Company GmbH, Munich, Fed. Rep. of Germany

[21] Appl. No.: 270,900

[22] Filed: Jun. 5, 1981

[30] Foreign Application Priority Data

Aug. 20, 1980 [DE] Fed. Rep. of Germany ..... 3031318

[51] Int. Cl.[3] ..... E05F 1/00; EO4B 7/16

[52] U.S. Cl. ..... 52/72; 49/158; 49/379; 49/386

[58] Field of Search ..... 52/72; 49/386, 379, 49/158

[56] References Cited

U.S. PATENT DOCUMENTS

| | | | |
|---|---|---|---|
| 470,896 | 3/1892 | Parrott | 52/72 X |
| 1,090,697 | 3/1917 | Eddelman | 49/386 X |
| 1,211,053 | 1/1917 | Bernard | 52/72 X |
| 2,827,003 | 3/1958 | Stetson | 52/72 |
| 2,909,254 | 10/1959 | Hallock | 49/386 |
| 4,300,440 | 11/1981 | Holter | 49/386 X |

*Primary Examiner*—Philip C. Kannan
*Attorney, Agent, or Firm*—Eugene E. Renz, Jr.

[57] ABSTRACT

In a window assembly including a panel mounted for pivotal movement relative to a casing in a roof sheathing, a moving rib attached to the panel and a guide rib operatively connected to the moving rib, actuating means for automatically pivoting the panel from a closed position overlying the casing to an open position disposed at a predetermined angle to the casing comprising a preloaded spring member, at least one actuating lever connected to said spring member, said actuating lever pivotally connected at its ends to the casing and guide rib and operable upon release of the panel from a closed position to effect pivotal movement of the panel to a predetermined angular position relative to the casing for a given linear displacement of said spring member and adjusting means for selectively varying the angular displacement of said panel by said actuating means.

11 Claims, 15 Drawing Figures

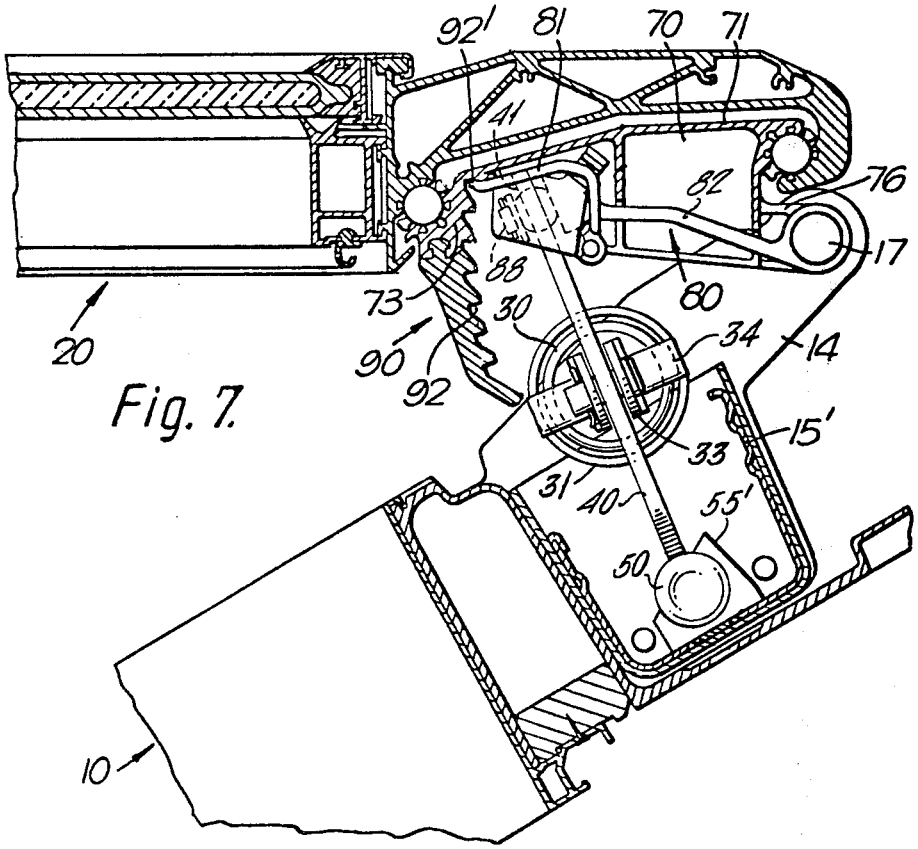
Fig. 7.
Fig. 8a.
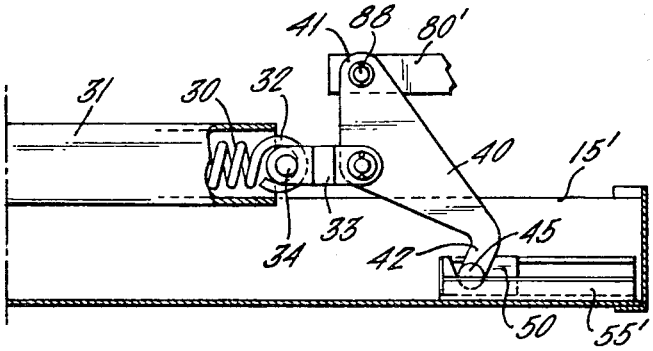
Fig. 8b.
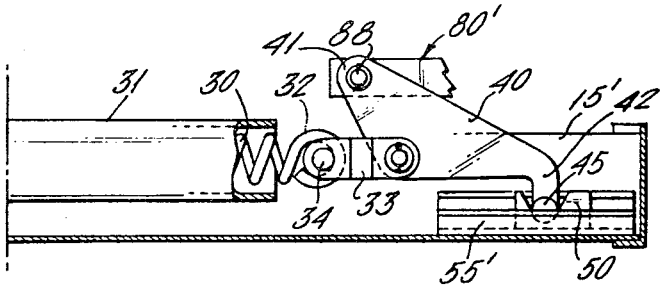

ATTIC WINDOW ASSEMBLY

BACKGROUND AND SUMMARY OF THE INVENTION

The present invention relates to attic windows pivotally supported in a casing mounted in a slanted roof including means for automatically actuating the window to a predetermined open position. The mounting arrangement for the window panel includes a moving rib which is moveable relative to a guide rib which in turn is pivoted relative to a shaft running parallel to the upper cross frame of the casing and including a pretensioned spring for pivoting the panel having a longitudinal axis parallel to the cross frame.

Attic windows of this general type are not new per se. A typical prior window assembly is shown in German Published Application No. 2,734,612. In this prior known attic window assembly, the guide rib is pivotally supported on a shaft in relation to the casing and the actuating spring is a torsion spring arranged inside the guide rib circumscribing the shaft. The spring is pretensioned to produce a limited pivotal movement of the guide rib relative to the shaft. Rotation of the shaft relative to the casing is prevented in this stage in order to produce a corresponding pivoting movement of the panel. The degree of this pivoting movement, and consequently the automatic pivotal opening of the attic window is limited by stops on the guide rib. For a given roof incliniation, the stops are oriented and arranged in such a way that the panel assumes a horizontal position after it is released from a closed position. In practice, however, roof inclinations vary between 30° and 60°. In this prior known attic window assembly, the automatic angular pivotal movement of the panel cannot be adapted by simple means to different roof inclinations in such a manner that the panel always assumes a generally horizontal position after release. Accordingly, this window is not suited for easy adaption to different roof inclinations.

In accordance with another prior tiltable attic window arrangement shown in German Pat. No. 1,939,350, scissor links are utilized to pivot a retaining frame which holds the window sash near the longitudinal side edges of a fixed casing. The scissor link mounts at its end an angle lever stop having several anchoring positions for an accompanying pull cord incorporating a weight balancing device with a tension spring. The maximum opening angle is varied or changed through the weight balancing arrangement. However, since the arrangement is rather complicated, accurate positioning of the retaining frame and sash is difficult and requires manipulation or adjustment of various mechanisms.

German Pat. No. 2,556,575 shows an attic window with a window casement which is automatically pivoted to an open position by two gas pressure springs after the window is released. The assembly is adaptable to different roof inclinations by adjusting the pivot points of the gas pressure springs thereby to vary the opening pressure. This also is a rather complicated assembly and in order to mount the window for automatic pivoting and lateral movement, the window assembly has an intermediate frame in addition to the casing of the panel. The gas pressure springs arranged near the longitudinal frames pivot the intermediate frame in relation to the casing while the panel may be moved laterally in relation to the intermediate frame. If the intermediate frame is eliminated as is the case in accordance with the present invention then pivoting of the gas pressure springs near the longitudinal frames is also eliminated.

With the foregoing in mind, it is an object of the present invention to provide an improvement in window assemblies of the above type, incorporating automatic actuator having easily manipulated adjustment means for selectively varying the degree of automatic opening of the panel without utilizing tools and complicated adjustment operations. In this manner the assembly is easily adjusted for a variety of roof inclinations and the panel always assumes a horizontal position after release to produce satisfactory airing and ventilation and also prevent ingress or penetration of rain and snow under normal conditions.

To this end the attic window assembly of the present invention comprises a panel pivotably mounted to a casement installed in the roof sheathing wherein the pivot support for the panel also permits lateral movement for installation and removal of the panel when desired or necessary. The mounting for the panel includes a first rib supported adjacent the rear edge of the panel by bearing means to a second guide rib pivotally mounted on a shaft secured to hinge means connected to the upper cross frame of the casing. The actuating mechanism includes a pretensioned spring arranged with its longitudinal axis parallel to the cross frame and a linkage mechanism connecting the ends of the spring to the guide rib. In the principal embodiment the linkage includes an actuating lever and at least one end of the spring is connected between the ends of the actuating lever which has one end hinged at a fixed pivot to the casing and its opposite end is pivotally and movably supported in a guide parallel to the spring longitudinal axis whereby movement of this end of the actuating lever produces a pivoting of the guide rib around the shaft. By this arrangement, displacement of the tension spring affects through the linkage mechanism pivotal movement of the guide rib relative to the shaft and in turn, pivotal movement of the first rib secured to the panel. In order to selectively vary automatic pivotal movement of the panel to a horizontal open position for various or different roof inclinations, the guide may be adjusted or fixed at different distances relative to the guide rib.

In another alternate embodiment, a compression or tension spring with at least one movable spring end likewise engages between the ends of an actuating lever but this actuating lever has one end hinged at a fixed pivot to the guide rib and the other end is movably supported in a guide movable relative to the casing and parallel to the spring longitudinal axis whereby the guide can now be fixed at a different distance relative to the casing.

In accordance with another feature of the present invention, there is provided a comparatively simple and effective means for selectively varying the pivotal movement of the guide and thereby the panel so that one actuating mechanism is suitable for use on roofs having different inclinations. This means consists of a ratchet-detent stop mechanism or click-stop device having a pivotal pawl which may be selectively positioned in a variety of locking positions of a catch element secured to the guide rib. The pawl may be selectively positioned in a given locking position simply by pivoting the panel relative to the casing. For example, assume the actuating mechanism is set for a roof having an inclination of 30° wherein the pawl engages in a first latch or locking position to effect automatic opening of the panel to a horizontal position. Now if it is desired to adjust the actuating mechanism for automatic opening of the panel to a horizontal position for a 60° roof inclination, the panel is simply pivoted manually beyond the first fully open position whereby the pawl releases from its locking position, traverses the detents and automatically seats in a new locking position for 60° inclination. If desired the different latch positions may be marked to facilitate positioning of the pawl in the desired locking position.

It is advantageous for an opening device which operates faultlessly in relation to the guide rib and the panel to utilize two actuating levers each provided with a guide, arranged at a certain distance from each other and the compression or tension spring is located between the two actuating levers whereby each of the spring ends is hinged to one of the actuating levers.

The actuating mechanism of the present invention is adapated for use in attic window assemblies in applications where the roof inclination may vary between 30° and 60°. If desired, the setting for a given roof inclination can be made at the assembly location before installation of the attic window without any elaborate adjusting manipulations and without tools. On the other hand in accordance with the present invention, a new setting may be made without difficulty and the setting is not limited to a horizontal position.

In accordance with the preferred embodiment of the invention, in order to adjust the final open position of the panel, it is only necessary to raise the panel once past the position whereby the tension spring automatically pivots the panel when it is relaxed to the desired position. The guide is then fixed at a certain distance to the guide rib and this fixed distance is maintained even after closing the window. Each release of the panel, relaxing of the tension spring automatically produces opening of the attic window to the desired preset selected position.

If desired, the connection between the actuating lever and the casing can be completely loosened with few manipulations so that the panel can be tilted fully upwardly if this should be desirable for access to the roof.

With the foregoing in mind, it is an object of the present invention to provide an attic window assembly of relatively simplified construction which incorporates mechanism for automatically raising the window to a preset horizontal position upon release of the window from the casing.

A further object to the present invention is to provide actuating mechanism which can be easily adjusted without difficulty or use of tools to effect pivotal movement of the panel automatically to a variety of positions so that a single actuating assembly may be utilized in roof installations having variable pitch inclinations of, for example, between 30° and 60°.

A still further object of the present invention is to provide a combined pivot and actuating mechanism where the panel assembly can be pivoted manually beyond the preselected position.

An additional object of the present invention is to provide an attic window assembly which is of comparatively simplified construction which can be manufactured and installed economically and is fully effective and reliable in operation even over an extended period of use.

BRIEF DESCRIPTION OF THE DRAWINGS

These and other objects of the present invention and the various features and details of the operation and construction thereof, are hereinafter more fully set forth with reference to the accompanying drawings, wherein;

FIGS. 7, 8*a* and 8*b* are enlarged fragmentary sectional views of a modified embodiment of the present invention wherein the lever of the actuating mechanism is connected at a fixed pivot to the guide rib.

DESCRIPTION OF THE PREFERRED EMBODIMENT

Figure 1:
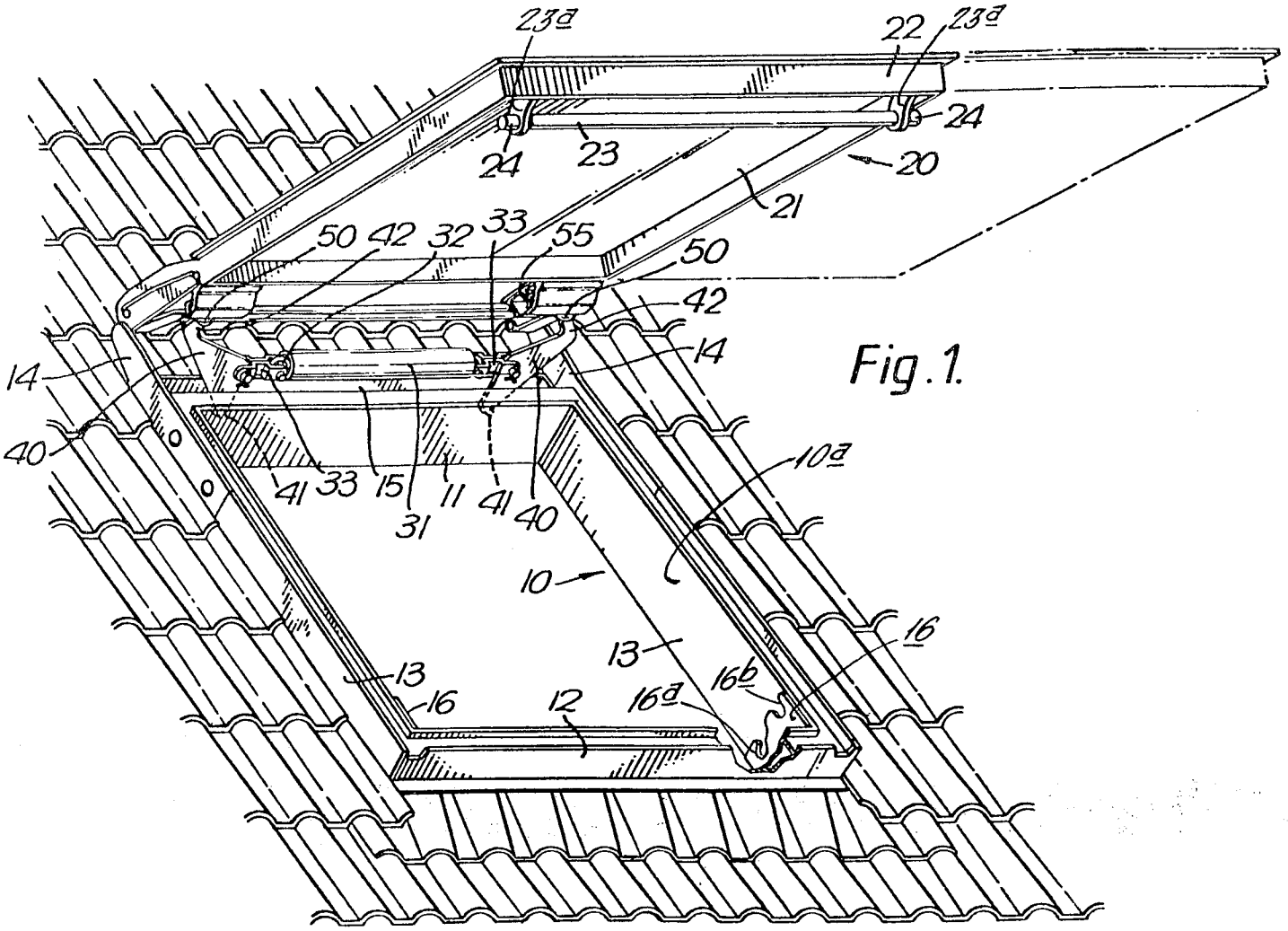
FIG. 1 is a perspective view of an attic window in a slanted roof constructed in accordance with the present invention.

Referring now to the drawings and particularly to FIG. 1, thereof, there is illustrated schematically an attic window assembly in a slanted roof incorporating automatic actuating means for opening the window to a predetermined generally horizontal position. The window assembly as illustrated comprises a casing or casement 10 consisting of spaced generally parallel upper and lower cross frames 11 and 12 and longitudinal side frames 13 extending between the cross frames and defining a generally rectangular window opening 10*a* and a panel 20 supporting a pane 21. The panel 20 is pivotally mounted and actuatable between a closed position overlying the opening 10*a* in the casing 10 and a raised or open position indicated in solid lines. The panel 20 is also moveable laterally in its pivot support for assembly and disassembly purposes as explained in more detail below, An elongated handle bar 23 which is mounted on brackets 23*a* pivotally supported on the panel member 22 and is engageable in notched recesses 16*a*, 16*b* formed in closing latches 16 mounted in opposing confronted faces of the longitudinal frame members 13 adjacent the lower end of the casing. The ends 24 of the handle bar 23 engage in the latch recesses 16*a* to secure the window in a closed position. To open the window, the user simply pivots the handle bar 23 inwardly to disengage the ends 24 from the latch recesses 16*a* whereby the actuating mechanism of the present invention raises the window automatically to a predetermined open position. The window may also be latched in a ventilating position by engaging the ends 24 in the notches 16*b* of the closing latch 16.

Figure 4A:
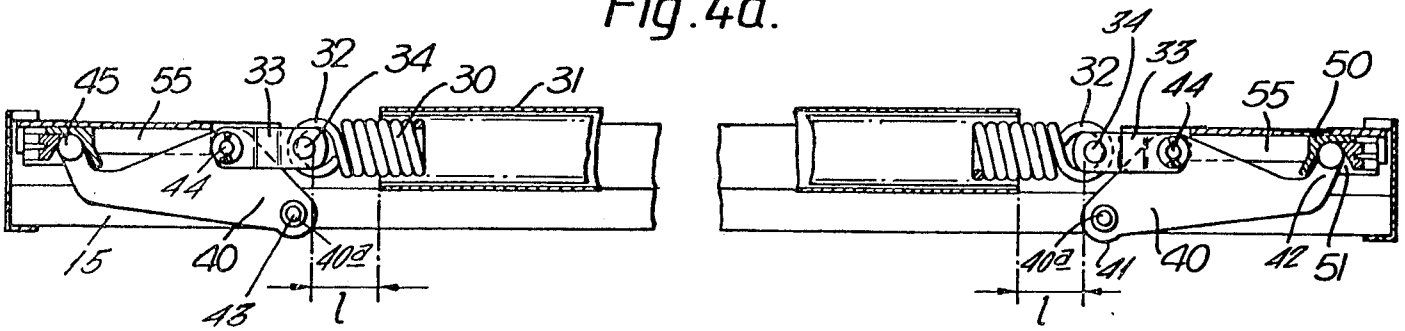
FIG. 4*a* is an enlarged longitudinal sectional view through the automatic window actuating mechanism for the assembly shown in FIG. 3*a;*
Figure 4B:
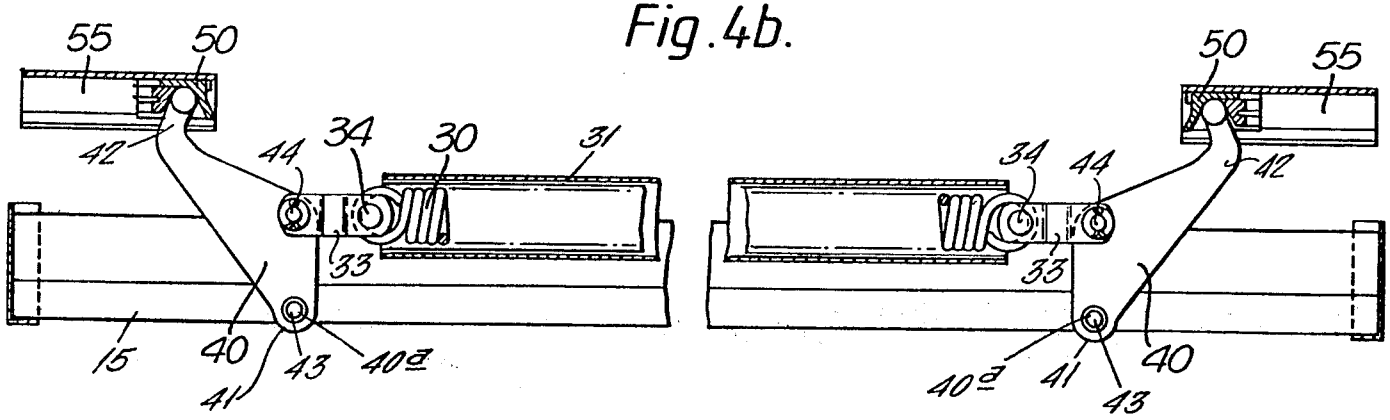
FIG. 4*b* is an enlarged longitudinal sectional view of the automatic actuating mechanism of FIG. 4*a* showing the position of the actuating elements when the attic window is in an open position as illustrated in FIG. 2*b* or 3*b;*

As best illustrated in FIGS. 4*a* and 4*b*, the automatic actuating means of the present invention includes an elongated tension spring 30, in the present instance a helical spring mounted in an elongated tubular member 31 operatively connected at its terminal ends to the panel 20 by a linkage system including generally triangular shaped actuating levers 40. As illustrated the actuating levers 40 are pivotally connected at their apex to the terminal ends of the spring 30 by shackles or connecting links 33 and each lever is pivotally mounted at one corner of its base to the support frame 15. The other corner of each link is connected to a slide piston 50 slidably supported in slides 55 which in turn are operatively associated with the panel 20. In this manner when the ends 24 of the handle are released or disengaged from the closing latches 16, the spring 30 contracts which in turn causes inward pivotal movement of the actuating levers 40 about pivot points 40*a* and the panel is thereby pivoted upwardly. The pivoting action of the levers and connecting linkages rotates the panel 20 upwardly about the shaft 17 to a predetermined open position, usually a horizontal position. The angular displacement of the panel 20 is determined by the linear contracting displacement of the spring 30 which is controlled and may be selectively varied to in turn provide means for selectively varying the angular displacement of the panel 20 for different roof inclinations as explained in more detail later. The spring characteristics and pretensioning are selectively chosen in relation to the weight of the panel and friction in the system so that it will raise the panel to a desired open position for a given contraction or linear displacement "L".

Figure 2A:
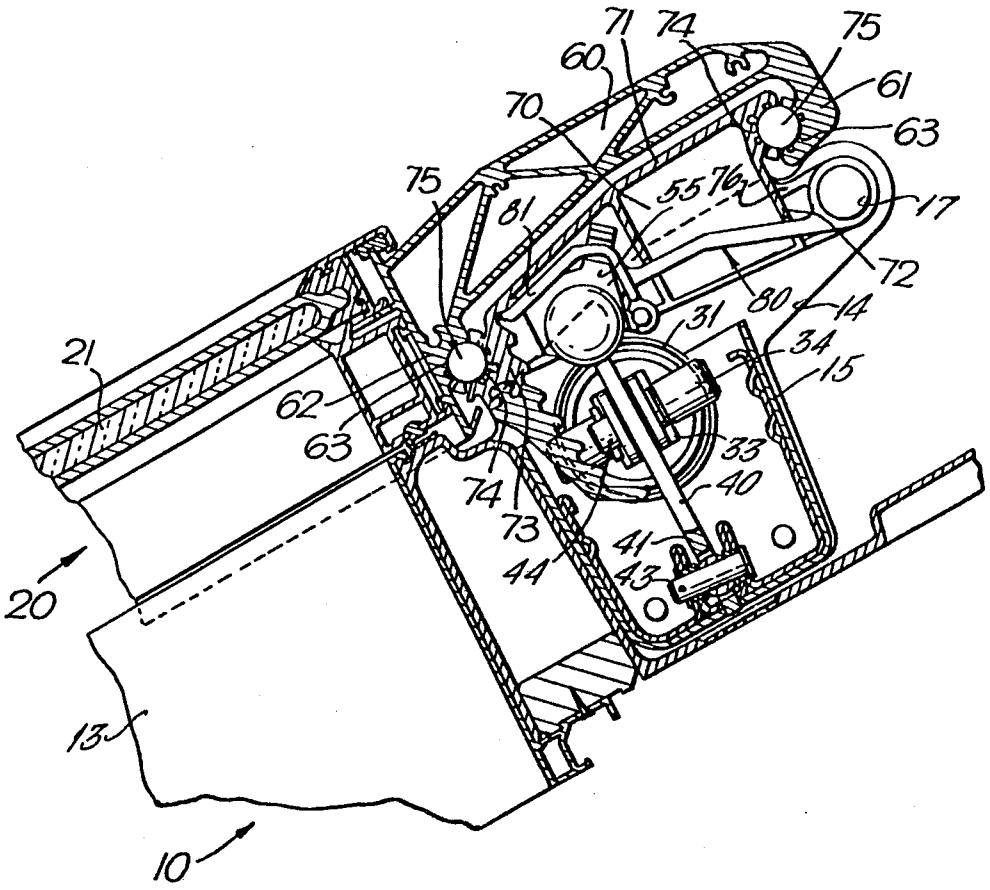
FIG. 2*a* is an enlarged fragmentary cross sectional view showing the details of the window panel actuating device for a closed attic window in a roof with a 30° inclination.

Considering now other elements of the automatic panel actuating means in more detail and with particular reference to FIG. 2*a*, a rib member 60 of generally C-shaped cross section is supported on one end of the panel 20 having spaced depending legs 61 and 62 formed with arcuate surfaces 63 defining part of a channel for a plurality of rolling elements, such as balls 75. A second rib member 70 is supported in the rib 60 adjacent the arched upper side thereof having arcuate contact surfaces 74 which confront and oppose the contact surfaces 63 of the rib 60 to form a guide race or channel for the balls 75. The balls 75 are supported in a conventional cage 75*a* to space the rib members 60 and 70 in the manner illustrated so that they pivot together as a unit. This arrangement also facilitates lateral movement of the ribs relative to one another for ease of assembly and disassembly of the panel 20 and rib member 60. A suitable stop member (not shown) may be provided to locate the panel 20 so that it registers accurately with the casement of the opening.

Figure 2B:
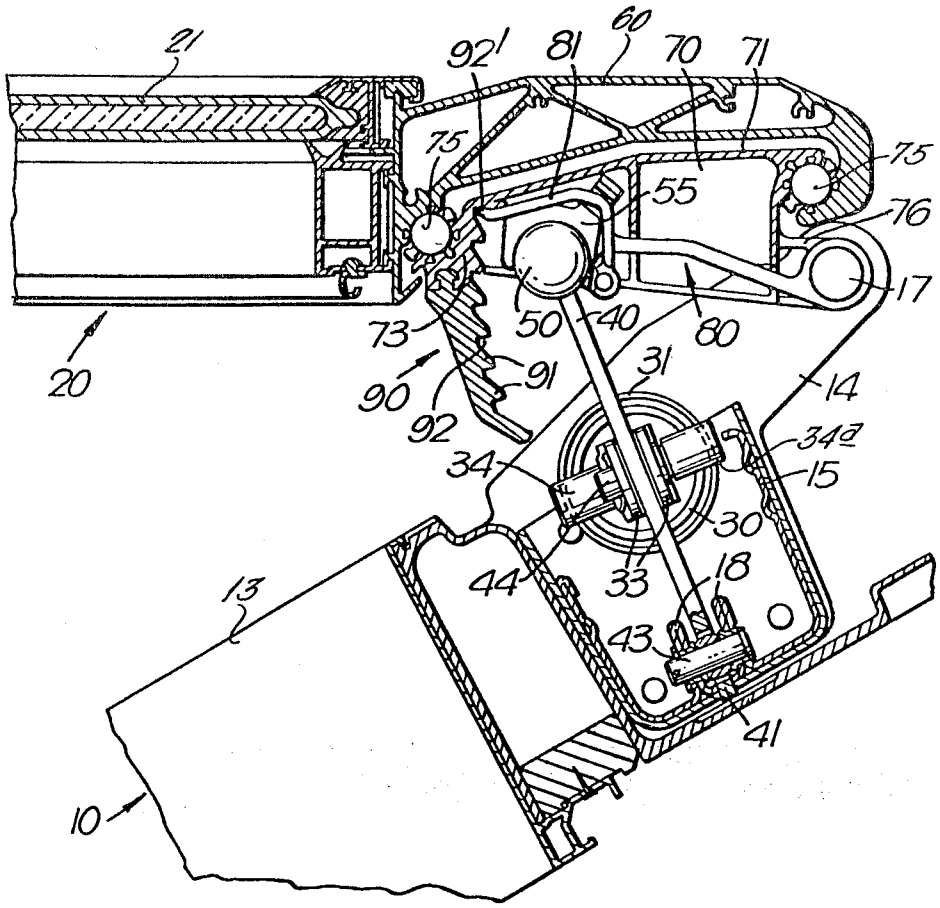
FIG. 2*b* is a cross sectional view similar to FIG. 2*a* with the panel in an open, horizontal position.
Figure 2D:
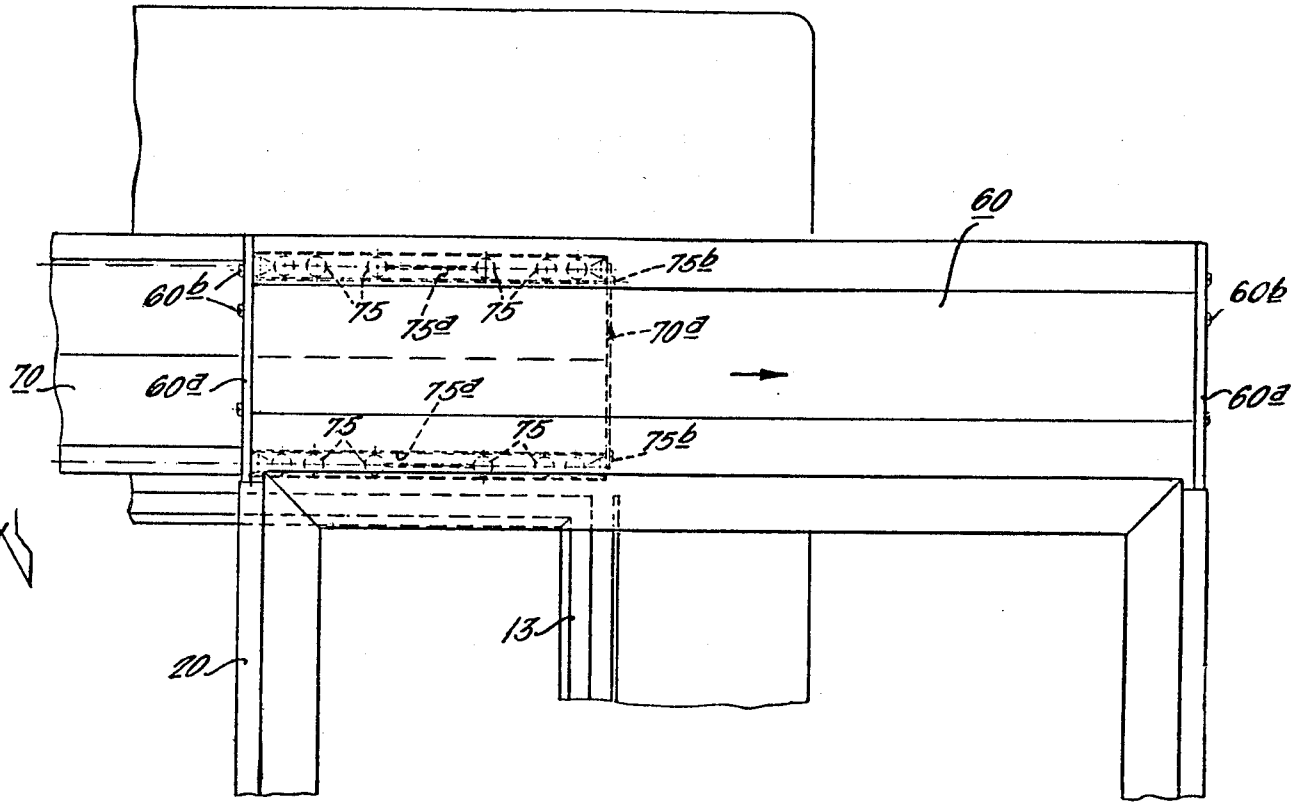
FIG. 2*d* is a fragmentary plan view showing the panel partially displaced relative to the window opening or frame.
Figure 2C:
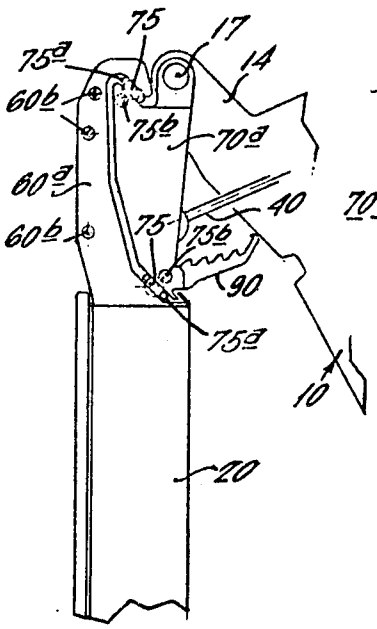
FIG. 2*c* is a fragmentary end view of the window actuating assembly and panel.

As illustrated in FIGS. 2*c* and 2*d*, the panel is mounted for limited lateral movement relative to the frame and to this end the C-shaped rib member 60 secured to the panel 20 is provided with end plates 60*a* at opposite ends thereof detachably secured by screws 60*b*. These plates 60*a* cooperate with end plates 70*a* on either end of the guide rib 70. As can be seen in FIG. 2*c*, the end plates maintain the balls 75 in the channel which is closed at its ends by the end plates. The panel 20 is easily removable by sliding it laterally simply removing one of the end plates 60*a* or 70*a*. Note, that the total length of the cage 75*a* for the balls 75 also defines the maximum lateral displacement of the panel 20. In a typical installation, the total length of the ball and cage assembly allows a lateral movement of the panel 20 until it clears about two-thirds ($\frac{2}{3}$) of the opening between the casement frame members 13. This arrangement maintains the desired stability of the assembly.

Considering now the details of the mounting arrangement of the guide rib 70 in relation to the casing 10, two elongated hinge plates 14 are mounted on the side frame members 13 and project rearwardly thereof in the manner illustrated in FIGS. 1 and 2*b*. The rearwardly extending portion of each opposing hinge plate mounts a bearing sleeve (not shown) within which is journaled a shaft 17 which in turn is connected to the guide rib 70 by means of a hinge frame 76. In this manner the guide rib 70 is held pivotally by the shaft 17 in its lower rear section. The forward section of the guide rib 70 adjacent the upper cross frame 11 is supported by the actuating levers 70. More specifically and as illustrated in FIG. 2*b*, the lower end 41 of each actuating lever 40 is supported in the channel shaped support 15 by a bolt 43 engaging through upstanding flanges in the base of the support 15. As noted above, the links or shackles 33 are pivotally connected to the levers 40, in the present instance, by a bolt 44 engaging through aligned bore holes and secured with a cotter pin. The links 33 are secured in a like manner by a bolt 34 to the tension spring 30 (see FIG. 4*a*). By this arrangement, the bolt 34*a* projects radially beyond the outer periphery of the spring tube 31 and as a result the spring displacement and hence pivoting of the levers 40 about their pivot points is limited. In other words, at such time as the handle bar 23 is released from the closing latch the spring 30 contracts to pivot the panel upwardly until the bolts 34 engage the terminal ends of the tube as illustrated in 4*b*. This limits the open position of the panel.

Each actuating lever 40 is hinged to a slide piston 50 at its upper terminal end 42. To provide for universal movement, this upper end of the lever has a ball or spherical tip which engages in a complementary socket in the slide piston 50. The slide piston reciprocates in the guide 55 which in turn is supported on a click-stop unit 80. The click-stop unit 80 includes a pawl 81 cooperable with a catch element depending from the forward end of the guide rib 70. In this manner, the guide rib 70 is mounted on the support 15 by means of two click-stop units 80, two guides 55 and two actuating levers 40. The click-stop provides for angular adjustment of the panel 20 relative to the casing 10 for a given pivotal displacement of the actuating levers 40 in a manner described in more detail below. In this manner the actuating mechanism can be simply adjusted so that the same mechanism can be used to pivot a window to a horizontal position for various typical roof inclinations ranging, for example, between 30° and 60°.

Figure 3A:
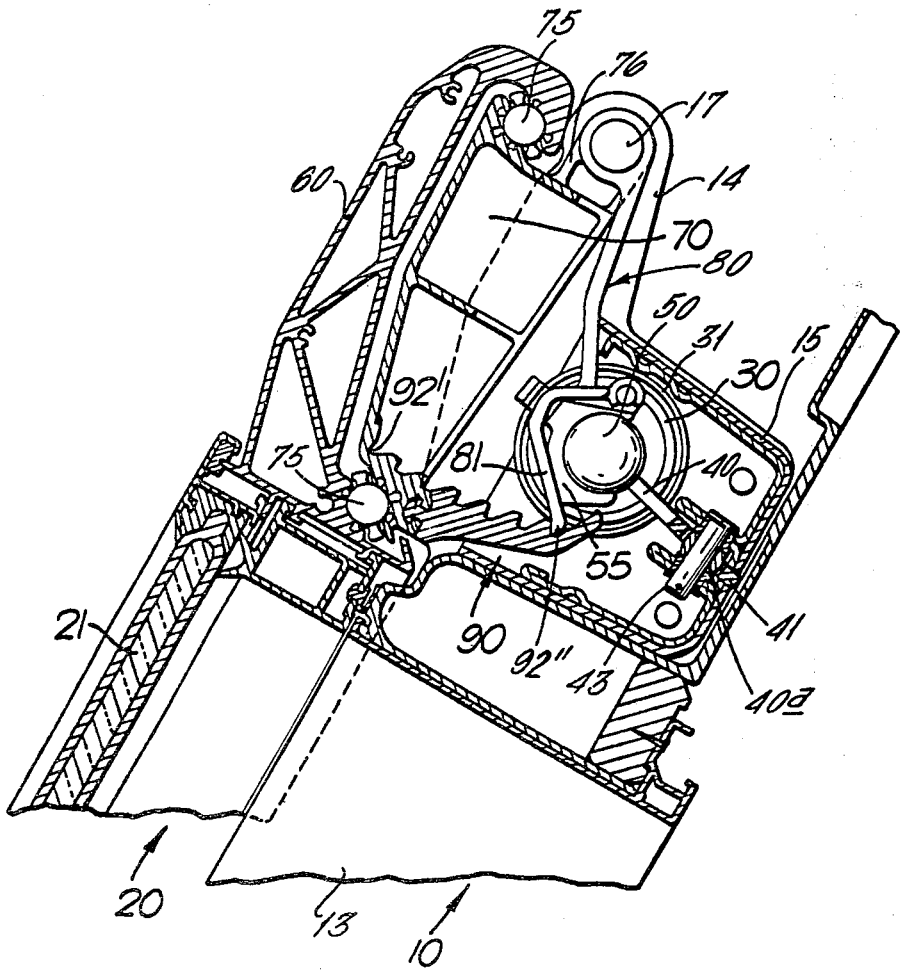
FIG. 3*a* is an enlarged cross sectional view similar to FIG. 2*a* for an attic window in a roof with a 60° inclination.

Consider now the sequence or action of the automatic actuating mechanism of the present invention. With the panel 20 in a closed position as illustrated in FIG. 3*a*, the guides 55, slide pistons 50, actuating levers 40 and extended tension spring 30 are in the relative positions illustrated in FIG. 4*a*. In this position the guides 55 are lowered and are located in about the same plane as the tension spring 30. The bolt 34 connecting the link 33 to the tensioned spring 30 is at a distance L from the end of the spring tube 31. After releasing the panel 20, the tension spring 30 contracts until each of the bolts 34*a* abuts the end of the spring tube 31 as shown in FIG. 4*b*. As a result of this spring contraction, the actuating levers 40 are pivoted toward one another about their fixed pivot points 40*a* which in turn results in lateral movement of each slide piston 50 in its respective guide 55. By this pivotal action, the guides 55 are raised and this elevating movement is transferred to the forward section of the guide rib 70 via the click-stop device 80 so that the guide rib 70 is in turn pivoted about shaft 17 and thus the panel 20 is pivoted to the position shown in FIG. 3*b*.

It is noted that the distance L produces an automatic opening of the panel by a predetermined amount with the contraction of the spring 30. The degree of automatic opening is preferrably set in such a way that for an attic window installed in a roof with a roof inclination of 30° or 60°, the panel assumes a generally horizontal position when the levers 40 have been pivoted to the position shown in FIG. 4*b*. In the fully open automaic position of FIG. 2*b*, the pawl 81 rests inside against the guide rib 70. The panel however, may be raised beyond the horizontal position manually and when this is done, one or several of the teeth of the catch element 90 bypass the pawl 81 until the tip of pawl 81 engages behind one of the teeth when the selected raised position is chosen and held securely in the selected position. As noted previously, the panel can be moved laterally for access through the casing opening or simply to remove the panel for other reasons.

The installation described above was for a roof having an inclination of 30° and 60°. It is noted that the assembly which has been used for a roof with a 30° inclination is suitable for a roof having an inclination of 60°. This functions in the following manner. When the panel is released, the same automatic pivoting action occurs to raise the panel except in this instance, the panel pivots automatically to a position below a horizontal position at the termination of the automatic opening cycle, since the assembly is set for a roof with a 30° inclination. However, by reason of the click-stop mechanism, it is possible to adjust the assembly for automatic opening of the panel to a horizontal position by adjusting the click-stop mechanism to the position shown in FIGS. 3*a* and 3*b*. Note that in this instance the pawl 81 engages in the lower locking position 92″. This is simply done by pivoting the panel until the pawl 81 seats in a new locking position. The guide rib 70 consequently assumes the largest possible distance in relation to the guide 55 and when closing the attic window, the actuating levers 40 are correspondingly pivoted further downward and the spring 30 is consequently extended further so that a longer spring path L results as shown in FIG. 4*a*. As a result of the longer spring path, the contraction of the spring 30 produces after the unlatching of the panel in angularly larger automatic opening so that again a horizontal position of the panel is achieved as illustrated in 3*b*. Thus, the assembly may be easily modified to effect automatic opening of a window panel for roofs having inclinations between 30° and 60° without constructively changing the mechanism of the attic window and specifically without changing the tension spring or the spring hinge points and by a simple adjustment of the pawl 81 in the catch element 90.

Figure 5:
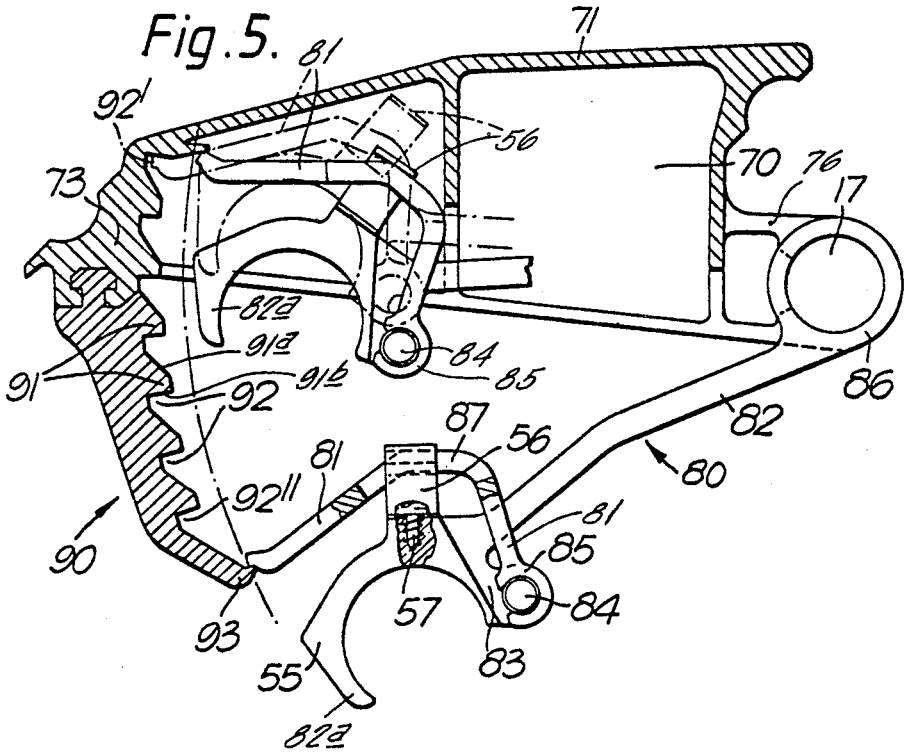
FIGS. 5, 6*a* and 6*b* are enlarged fragmentary sectional views of the click-stop device for the window actuating mechanism illustrated in the previously described figures.
Figure 6A:
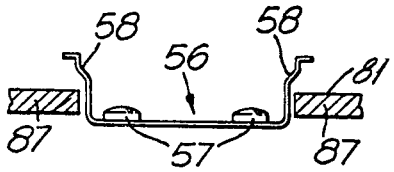
Figure 6B:
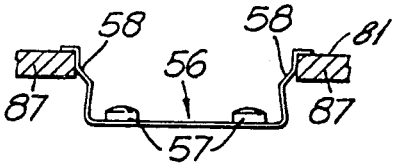

The structural details and arrangement of the click-stop device are best illustrated in FIGS. 5, 6*a* and 6*b*. As illustrated therein, the click-stop device generally designated by the numeral 80 comprises a slightly angular plate-shaped holder 82 which is pivotally supported at its outer end on the shaft 17 and at its opposite terminal end has a claw like projection 82*a* to support the tubular guide 55 and a pawl 81 pivotally mounted on the projection 82*a* by means of a pin 84. The projecting part of the pawl 81 is held by a support piece 85 of the pawl. The entire click-stop device or assembly 80 with the securely mounted guide 55 is arranged pivotally on the shaft with the back end of the guide as noted above constructed as a bearing sleeve 86. By this arrangement, the guide rib 70 and the spaced pair of click-stop devices 80 can be pivoted relative to the shaft 17 independently from one another. Pawl 81 cooperates with the catch element 90 which extends in cantilevered fashion from the front narrow side 73 of the rib 70. The catch 90 has a number of teeth 91 on the inner face thereof defining a plurality of spaced locking positions 92, 92′ and 92″. The teeth are formed with a beveled top surface 91*a* and a shoulder 91*b* to facilitate ratcheting movement of the pawl 81 over the teeth in one direction and firm locking of the ratchet 81 under a shoulder 91*b* in a selected position. The teeth 91 and the locking positions 92 are disposed on concentric circles with the pivotal axis of the shaft 17 as the center point.

In the normal starting position, the pawl 81 is located in the upper locking location 92′ (shown in broken lines in FIG. 5). If it is desired to position the pawl 81 in other locking locations, the guide rib 70 is simply raised or pivoted so that teeth 91 sweep the pawl 81 which is slightly pivoted away from each tooth while the holder 82 remains fixed in its position via the guide 55, the slide piston 50 and the actuating lever 40 (see FIG. 2*b*). Raising the guide rib, of course, takes place via a corresponding manual lifting of the panel 20 which movement is transferred to the guide rib 70 by the rib 60. After raising the panel to the desired level, the pawl 81 slides forward as a result of the action of its own weight to engage the catch element 90 and lock with its tip in the appropriate position 92. The guide 55 is now fixed at the selected distance to the guide rib 70 via the click-stop device or unit 80.

In the event that an incorrect position for locking the panel has been selected in the manner described above or that a new different setting should be desired, means is provided for latching the pawl 81 in a position wherein it does not contact the catch member 90 upon pivotal movement of the click-stop device over its range. This movement of the click-stop device is shown in solid lines in FIG. 5. To this end, a U-shaped retaining spring 56 is mounted on the back face of the guide 55 by screws 57 and an opening is provided in the back of the pawl 81 through which the opposing legs of the retaining spring pass. As best illustrated in FIGS. 6*a* and 6*b*, the legs 58 are shaped or bent so that in one position, illustrated in FIG. 6*a*, the back of the pawl 81 can freely move in relation to the retaining spring 56 while in a second position, illustrated in FIG. 6*b*, the ends of the legs 58 are in spring contact with the walls of the opening provided in the back of the pawl to retain the pawl in the raised position relative to the guide 55 shown in FIG. 5. The first case occurs when the pawl is located in a locking position 92, 92′, 92″. The second case occurs when the guide rib 70 and along with it the catch element 90 has been raised so far that the end section 93 of the catch element 90, which is jutting out inwardly, raises the pawl 81 (see FIG. 5 with the drawn illustration of the click-stop device component 80 in the lower portion of the figure).

In the raised position of the pawl 81, the guide rib 70 can be pivoted downward and the teeth 91 of the catch element 90 pass freely since the tip of the pawl 81 moves in an arc spaced inwardly from the teeth 91 of the catch element 90. Pawl 81 is released from this raised or locked position by returning the pawl to a position engaging the inside surface of the guide rib 70. (see broken line position in FIG. 5). In this position, the pawl engages the guide rib to push it downwardly and consequently release it from the frictionally engaged position with the retaining spring 56. The tip of the pawl now is in a position where it again engages in the upper locking position 92' so that if the guide element and panel are now raised, the pawl will again engage the teeth 91 of the ratchet detent 90 to permit selection of a new setting or locking position and the distance setting of the guide 55, in relation to the guide rib 70 can consequently be implemented.

Figure 3B:
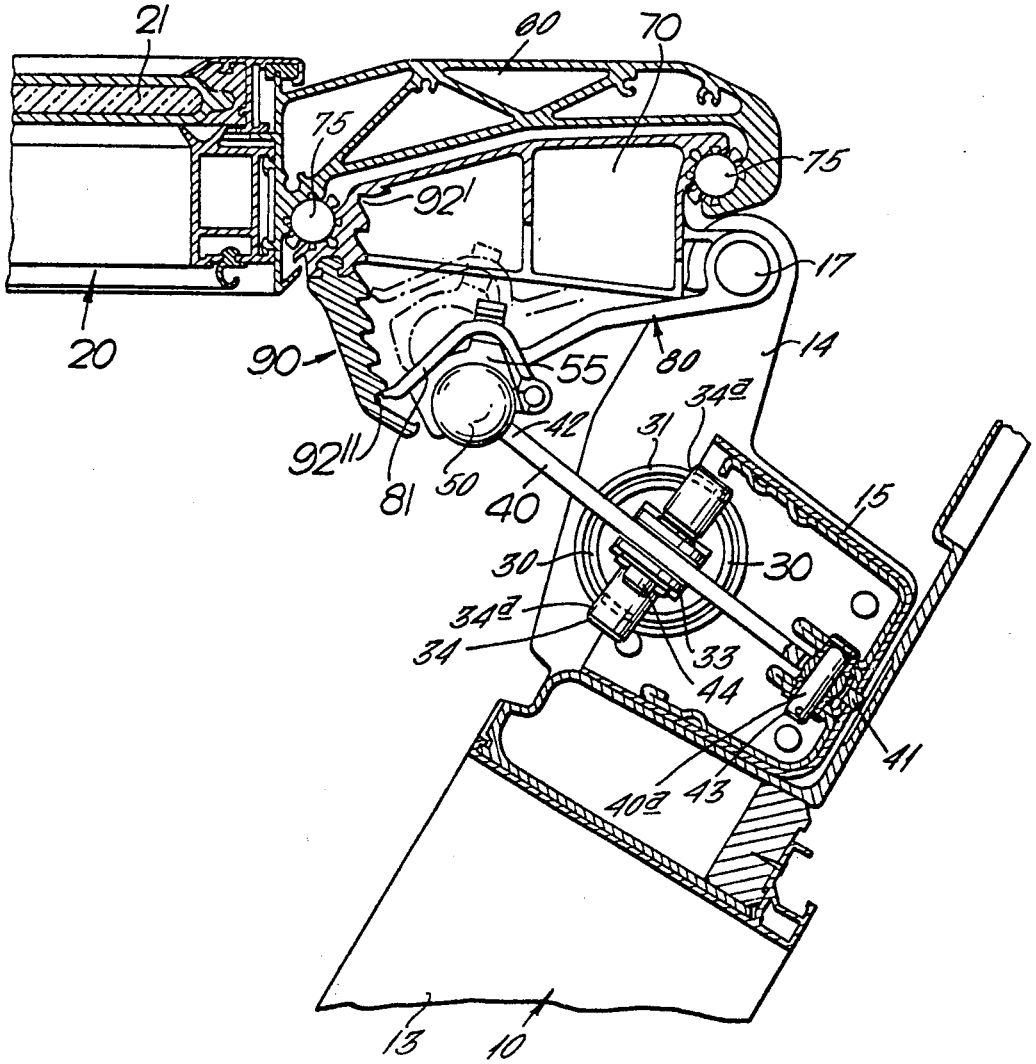
FIG. 3*b* is an enlarged cross sectional view of the assembly shown in FIG. 3*a* except showing the panel actuated to an open, horizontal position.

FIGS. 3*a* and 3*b* illustrate the window assembly installed in a roof with an inclination of 60°. Note that in order to now effect pivotal movement of the panel to a horizontal open position after release, it is only necessary to reposition the pawl 81 in a selected new location in the catch element 90 without changing the basic actuating mechanism such as the tension spring or spring hinge points. Pawl 81 which may normally be disposed in the upper locking position 92' as illustrated in FIGS. 2*a* and 2*b* may simply be released from the locking position 92' by appropriate pivotal raising of the panel 20 until the pawl is engaged in a lower locking position such as 92''. In this position, the guide rib assumes the largest possible distance in relation to the guide 55 and upon closing the attic window, the actuating levers 40 are correspondingly pivoted further downward and the spring 30 is likewise extended further so that a longer spring path L results as shown in FIG. 4*a*. By reason of a longer spring displacement, there is a greater contraction of the spring when the panel is released, and consequently a larger angular displacement of the panel 20 until the bolts 34*a* abut the axial ends of the tube 31 (see FIG. 3*b*.)

An alternate embodiment of window assembly is shown in FIGS. 7, 8*a* and 8*b*. The structural details of the actuating mechanism are identical to that described previously. However, in this instance, the lever 40 of the actuating mechanism has one end 41 hinged at a fixed pivot 88*a* to the click-stop device, plate shaped holder 80 and the other end 42 is movably supported in a guide 55' movable relative to the longitudinal axis of the spring 30 whereby movement of this end 42 of the actuating lever affects a pivoting of the guide rib 70 about the shaft 17 and the guide 55' can now be fixed at various preselected distances relative to the casing 10 and the actuating assembly thereby adjusted for roofs of inclinations ranging for example, between 30° and 60°.

Even though particular embodiments of the invention have been illustrated and described herein, it is not intended to limit the invention and changes and modifications may be made therein within the scope of the following claims. For example, even though a helical tension spring has been illustrated, other spring arrangements to effect the automatic opening action may be utilized.

We claim:

1. In a window assembly including a panel mounted for pivotal movement relative to a casing in a roof sheathing, a moving rib attached to the panel and a guide rib operatively connected to the moving rib, actuating means for automatically pivoting the panel from a closed position overlying the casing to an open position disposed at a predetermined angle to the casing comprising at least one actuating lever, a preloaded spring member connected between the ends of said actuating lever, one end of said actuating lever pivotally connected to the guide rib at a fixed pivot and the other end of said acutating lever being movably supported in a guide parallel to the longitudinal axis of said spring member whereby upon release of the panel from a closed position, movement of the other end of the actuating lever effects a pivoting of the guide rib and panel to a predetermined angular position relative to the casing for a given linear displacement of said spring member and wherein said guide may be fixed at different distances relative to the casing for selectively varying the angular displacement of said panel by said actuating means.

2. In a window assembly as claimed in claim 1 wherein said spring member is connected between the ends of said actuating lever, one end of said actuating lever being pivotally mounted to the casing at a fixed pivot and the other end of said actuating lever being moveably supported in a guide parallel to the longitudinal axis of the spring whereby displacement of said other end of said actuating lever effects a pivoting of the guide rib and wherein said guide may be fixed at a different distance relative to said guide rib.

3. In a window assembly as claimed in claim 1 wherein said actuating means includes a pair of actuating levers, one of said actuating levers pivotally connected to one end of said spring member and the other actuating lever pivotally connected to the opposite end of said spring member.

4. In a window assembly as claimed in claim 1 wherein said spring member comprises a tension spring.

5. In a window assembly as claimed in claim 1 wherein the movable end of said actuating lever is hinged to a slide piston supported in said guide.

6. In a window assembly as claimed in claim 1, including a click-stop assembly operatively associated with said guide including adjusting means for selectively fixing the guide in various locking positions at predetermined distances relative to the guide rib.

7. In a window assembly as claimed in claim 6 wherein said click-stop mechanism includes a pawl pivotally mounted on said guide and engageable in a selected one of a plurality of locking positions in a catch element secured to said guide rib.

8. In a window assembly as claimed in claim 7 wherein said pawl automatically engages when said panel is raised in sequential locking positions of said catch member.

9. In a window assembly as claimed in claim 7 wherein said pawl can be selectively released from said catch member and can be fixed in a predetermined selected position.

10. In a window assembly including a panel mounted for pivotal movement relative to a casing in a roof sheathing, a moving rib attached to the panel and a guide rib operatively connected to the moving rib, said ribs having confronting arcuate contact surfaces which define a channel, a plurality of rolling elements in said channel, said moving rib adapted to move in a lateral direction relative to said casing over the guide rib when removal or installation is desired, said moving rib and guide rib adapted to pivot as a unit when the panel moves from a closed to an open position, an actuating means for automatically pivoting the panel from a closed position overlying the casing to an open position disposed at a predetermined angle to the casing, an adjusting means for selectively varying the angular displacement of said panel by said actuating means.

11. In a window assembly including a panel mounted for pivotal movement relative to a casing in a roof sheathing, actuating means for automatically pivoting the panel from a closed position overlying the casing to an open position disposed at a predetermined angle to the casing, means operatively connecting said panel and actuating means including a click stop mechanism for selectively varying the angular displacement of said panel including a guide pivotally mounted to said panel and adapted for adjusting said actuating means, a pawl pivotally mounted on said guide and engageable in a selected one of a plurality of locking positions in a catch element extending from said panel, said pawl cooperating with the catch element to selectively vary the distance between said guide and said panel thereby effecting varying angular displacements of said panel for a given setting of said click stop mechanism.

* * * * *